US009400134B2

(12) United States Patent
Jager

(10) Patent No.: US 9,400,134 B2
(45) Date of Patent: Jul. 26, 2016

(54) METHOD AND APPARATUS FOR LIQUEFYING A HYDROCARBON STREAM

(75) Inventor: Marco Dick Jager, The Hague (NL)

(73) Assignee: Shell Oil Company, Houston, TX (US)

( * ) Notice: Subject to any disclaimer, the term of this patent is extended or adjusted under 35 U.S.C. 154(b) by 1802 days.

(21) Appl. No.: 12/375,552

(22) PCT Filed: Jul. 31, 2007

(86) PCT No.: PCT/EP2007/057924

§ 371 (c)(1),
(2), (4) Date: Jan. 29, 2009

(87) PCT Pub. No.: WO2008/015224

PCT Pub. Date: Feb. 7, 2008

(65) Prior Publication Data

US 2009/0314030 A1 Dec. 24, 2009

(30) Foreign Application Priority Data

Aug. 2, 2006 (EP) ..... 06118290

(51) Int. Cl.
*F25J 1/00* (2006.01)
*F25J 1/02* (2006.01)

(52) U.S. Cl.
CPC ..... *F25J 1/0022* (2013.01); *F25J 1/0052* (2013.01); *F25J 1/0055* (2013.01); *F25J 1/0057* (2013.01);
(Continued)

(58) Field of Classification Search
CPC ..... F25J 1/0022; F25J 1/0052; F25J 1/0055; F25J 1/0087; F25J 1/0265; F25J 1/0218; F25J 1/029; F25J 1/0216
USPC ..... 62/612
See application file for complete search history.

(56) References Cited

U.S. PATENT DOCUMENTS 3,763,658 A 10/1973 Gaumer, Jr. et al. ..... 62/40
4,404,008 A 9/1983 Rentler et al. ..... 62/11
(Continued)

FOREIGN PATENT DOCUMENTS

DE 3521060 12/1985 ..... F25J 1/00
GB 1487466 9/1977
(Continued)

OTHER PUBLICATIONS

International Search Report dated Sep. 8, 2008 (PCT/EP2007/057924).
(Continued)

*Primary Examiner* — Keith Raymond

(57) ABSTRACT

Method of liquefying a hydrocarbon stream from a feed stream including (a) passing the feed stream through a first cooling stage having at least two heat exchangers and against a component refrigerant in a first refrigerant circuit, to provide a cooled hydrocarbon stream; (b) passing the cooled hydrocarbon stream through a second cooling stage against a second refrigerant in a second refrigerant circuit, to provide a liquefied hydrocarbon stream; (c) passing the second refrigerant through one of the heat exchangers of the first cooling stage. The heat exchangers of the first cooling stage are shell and tube heat exchangers having two or more tube circuits. The first refrigerant circuit includes a refrigerant compressor and the second refrigerant circuit includes a refrigerant compressor. The refrigerant compressor of the first refrigerant circuit and the refrigerant compressor of the second refrigerant circuit are interconnected and are arranged to be driven by a common driver.

13 Claims, 2 Drawing Sheets

(52) U.S. Cl.
CPC ..... *F25J 1/0087* (2013.01); *F25J 1/029* (2013.01); *F25J 1/0216* (2013.01); *F25J 1/0218* (2013.01); *F25J 1/0262* (2013.01); *F25J 1/0264* (2013.01); *F25J 1/0265* (2013.01); *F25J 1/0272* (2013.01); *F25J 1/0278* (2013.01); *F25J 1/0292* (2013.01); *F25J 2220/64* (2013.01); *F25J 2220/68* (2013.01)

(56) References Cited

U.S. PATENT DOCUMENTS

| | | | | |
|---|---|---|---|---|
| 5,537,827 | A * | 7/1996 | Low et al. | 62/613 |
| 6,389,844 | B1 | 5/2002 | Klein | 62/612 |
| 6,640,586 | B1 | 11/2003 | Baudat et al. | 62/612 |
| 6,691,531 | B1 | 2/2004 | Martinez et al. | |
| 6,898,949 | B2 | 5/2005 | Paradowski | 62/613 |
| 2003/0089125 | A1 * | 5/2003 | Fredheim et al. | 62/612 |
| 2009/0019888 | A1 * | 1/2009 | Bauer et al. | 62/614 |

FOREIGN PATENT DOCUMENTS

| | | | | |
|---|---|---|---|---|
| WO | WO9733131 | | 9/1997 | F25J 1/02 |
| WO | WO 9733131 | A1 * | 9/1997 | |
| WO | 9801335 | | 1/1998 | |
| WO | WO2006050913 | | 5/2006 | F25J 1/02 |

OTHER PUBLICATIONS

Shukri T:"LNG Technology Selection", Intl Jrnl of Hydrocarbon Engineering, Palladian Publications, Elstead, GB, Feb. 2004, pp. 71-74.

Perez V, et al: "The 4.5 MMTPA LNG Train—A Cost Effective Design Train De GNL DE4.5 MMTPA-UNE Conception Economique", Intl. Conference and Exhibition on Liquefied Natural Gas, May 4, 1998, pp. 1-15.

Tarakads R R, et al: "Modular Engineering—Applications in Liquefaction Plant Design", GASTECH Meeting on LNG and LPG, Nov. 25, 1986, p. 406.

* cited by examiner

METHOD AND APPARATUS FOR LIQUEFYING A HYDROCARBON STREAM

The present application claims priority from European Patent Application 06118290.3 filed 2 Aug. 2006.

FIELD OF THE INVENTION

The present invention relates to a method and apparatus for liquefying a hydrocarbon stream, particularly but not exclusively natural gas.

BACKGROUND OF THE INVENTION

Several methods of liquefying a natural gas stream thereby obtaining liquefied natural gas (LNG) are known. It is desirable to liquefy a natural gas stream for a number of reasons. As an example, natural gas can be stored and transported over long distances more readily as a liquid than in gaseous form because it occupies a smaller volume and does not need to be stored at a high pressure.

In an article by Perez, V. entitled "The 4.5 MMTBA LNG Train—A Cost Effective Design", published on 4 May 1998 from the International Conference and Exhibition on Liquefied Natural Gas, there is discussed plant designs for attaining a 4.5 MMTPA nominal capacity LNG train. This involves a set of heat exchangers for cooling a treated feed gas before entering a scrub column. The overhead vapour from the scrub column is then liquefied in a Main Cryogenic Heat Exchanger (MCHE) against a mixed refrigerant. The article states that the propane refrigerant system utilises propane evaporating at four pressure levels, the heat exchangers for which are shown in FIG. 1 as being separate from those for the feed gas. FIG. 3 shows a Frame 7 gas turbine driving a propane compressor and High Pressure Mixed Refrigerant (HPMR) compressor, and the four propane heat exchangers.

SUMMARY OF THE INVENTION

It is an object of the present invention to improve the efficiency of a liquefying process and apparatus.

It is another object of the present invention to reduce the capital and running costs for a method and apparatus for liquefying a hydrocarbon stream.

One or more of the above or other objects can be achieved by the present invention providing a method of liquefying a hydrocarbon stream such as natural gas from a feed stream, the method at least comprising the steps of:

a) passing the feed stream through a first cooling stage having at least two heat exchangers, and against a first refrigerant in a first single component refrigeration circuit, to provide a cooled hydrocarbon stream;

b) passing the cooled hydrocarbon stream through a second cooling stage against a second refrigerant in a second refrigerant circuit, to provide a liquefied hydrocarbon stream;

c) passing the second refrigerant through one or more of the heat exchangers of the first cooling stage; wherein the heat exchangers of the first cooling stage are shell and tube heat exchangers having two or more tube circuits, the feed stream passing through one tube circuit in each shell and tube heat exchanger and the second refrigerant passing through another tube circuit in each shell and tube heat exchanger, and wherein the first refrigerant passes through the shell and tube heat exchangers around the feed stream and second refrigerant; and wherein the first refrigerant circuit includes one or more refrigerant compressors and the second refrigerant circuit includes one or more refrigerant compressors, and wherein at least one refrigerant compressor of the first refrigerant circuit and at least one refrigerant compressor of the second refrigerant circuit are mechanically interconnected and are arranged to be driven by a common driver.

BRIEF DESCRIPTION OF THE DRAWINGS

Embodiments of the present invention will now be described by way of example only, and with reference to the accompanying non-limiting drawings in which.

DETAILED DESCRIPTION OF THE INVENTION

Figure 1:
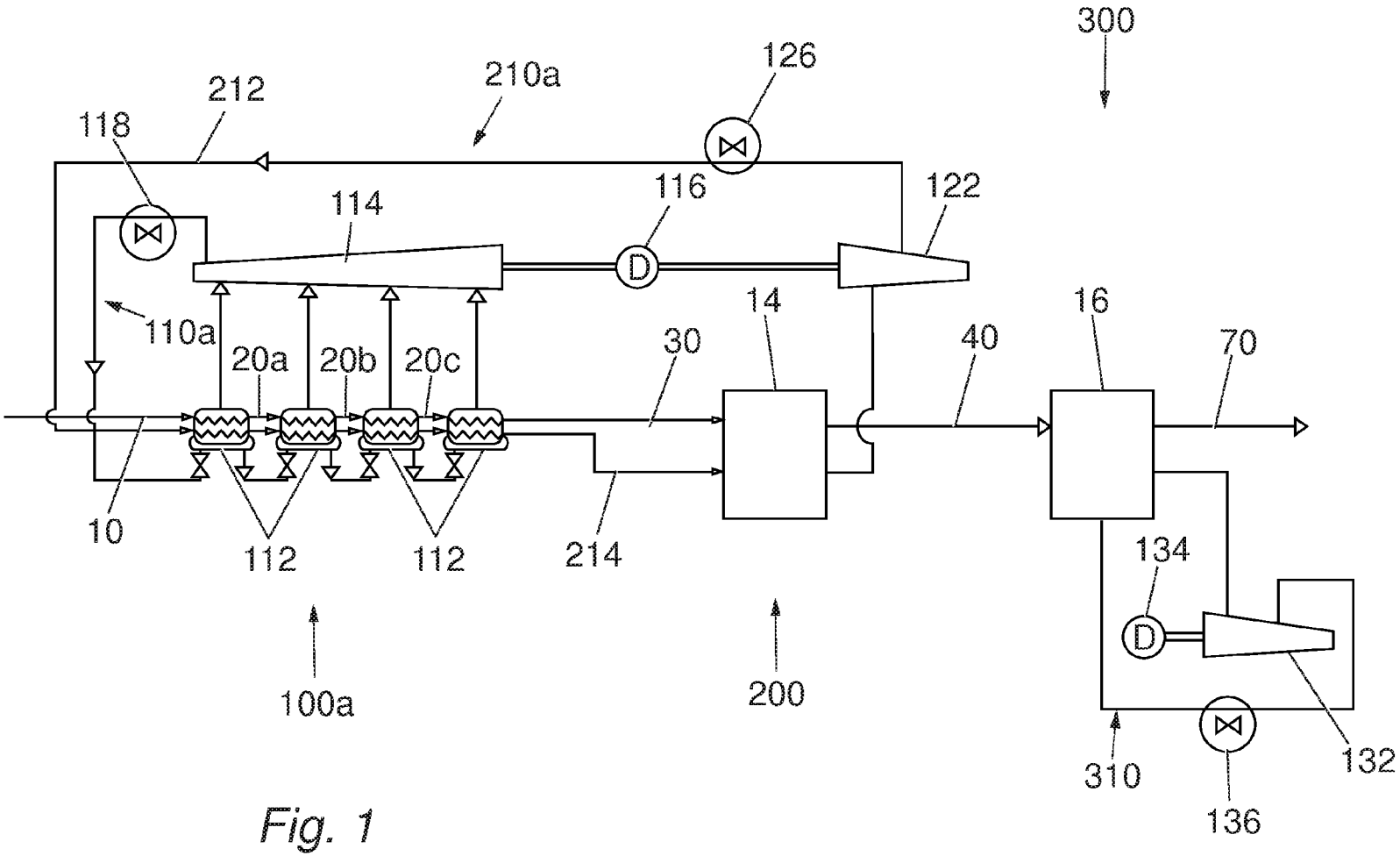
FIG. 1 is a scheme for a liquefying process according to one embodiment of the present invention.

An advantage of the present invention is that by passing the second refrigerant through at least one of the heat exchangers of the first cooling stage, there is a reduction in the cooling requirement for the second refrigerant before its use in the second cooling stage. This may reduce, possibly eliminate, the need for separate second refrigerant cooling equipment and units in association with the second cooling stage. This reduces the capital costs (e.g. equipment count) and running costs of a liquefying method and apparatus. It also reduces the space required for such method and apparatus. In some situations or locations, such as on board a vessel such as a ship or a floating platform, space or spacing can be critical, so that any saving of space is significant.

This is particularly advantageous where the method of liquefying is intended to be compact and provide a nominal capacity (or name plate) of liquefied hydrocarbon, such as ≤3 millions of (metric) tons per annum (MTPA). The term "nominal capacity" is defined as the daily production capacity of a plant multiplied by the number of days per year the plant is intended to be in operation. For instance, some LNG plants are intended to be operational for an average of 340 days per year.

Such a compact or small scale design is also based on common driving of the one or more refrigerant compressors of the first and second refrigerant circuits. In particular, the present invention utilises one compressor driver for all the compression of the first and second refrigerant circuits.

Another advantage of the present invention is the use of the minimum number of shell and tube heat exchangers in the first cooling stage for cooling the feed gas and the second refrigerant. Typically, the number of heat exchangers in the first cooling stage is between 2-5, preferably 4 or 5, more preferably 4 heat exchangers.

A further advantage of the present invention is that a single component first refrigerant such as propane can be more conveniently used in different heat exchangers, especially at different pressures or pressure levels, than a mixed-refrigerant, such that the first cooling of the feed stream can be more efficiently arranged. Such pressures could be defined as: low pressure, medium pressure, high pressure and high pressure. The expanded refrigerant from each pressure level could be compressed in one or more compressors known in the art.

An advantage of the use of different first refrigerant pressures is the better efficiency of providing cooling and/or the recompression of a single component refrigerant compared with other refrigerants hitherto used for pre-cooling natural gas, most especially mixed refrigerants.

Another advantage of the present invention is that a single component refrigeration circuit is less expensive than a mixed refrigerant refrigeration circuit, more particularly in the use of multiple heat exchangers and/or multiple pressures or pressure levels to effect the cooling. For example, tube-in-kettle heat exchangers, which can use single component refrigerant, are significantly cheaper than spool wound heat exchangers, which cannot.

The first cooling stage in step (a) is provided by the passage of the feed stream through two or more heat exchangers. At least one heat exchanger used in the first cooling stage, optionally all the heat exchangers used, is preferably wholly or substantially supplied with cooling by the first refrigerant.

The first refrigerant is a single component refrigerant. The term "single component refrigerant" means that the refrigerant comprises >90 mol %, preferably >95 mol %, more preferably >98 mol % and even more preferably >99 mol % of a refrigerant component, such as propane. The first single component refrigerant can comprise >90 mol % propane. Preferably, the first single component refrigerant comprises >95 mol % propane, more preferably >98 mol % propane, even more preferably >99 mol % propane.

Preferably, the first cooling stage comprises at least two heat exchangers, optionally three, four or five heat exchangers. The second refrigerant could pass through any number of the heat exchangers of the first stage, for example one, two, all but one, all but two, etc., heat exchangers.

In one embodiment of the present invention, the first and second refrigerants pass through the same heat exchangers of the first cooling stage. Thus, at least one, preferably all, of the heat exchangers of the first cooling stage provide cooling to the feed stream and the second refrigerant.

The second cooling stage of step (b) may be provided by passing the first cooled feed stream through one or more sections, each section using one or more heat exchangers. The or each heat exchanger of the second cooling is preferably supplied with cooling by a mixed refrigerant in the second refrigerant circuit. Additional cooling of the cooled hydrocarbon stream from the first cooling stage and/or the second refrigerant could be provided by one or more other refrigerants or refrigerant cycles in addition to cooling by the first cooling stage, optionally being connected with another part of the method and/or apparatus for liquefying a hydrocarbon stream as described herein.

The hydrocarbon stream may be any suitable gas stream to be treated, but is usually a natural gas stream obtained from natural gas or petroleum reservoirs. As an alternative the natural gas stream may also be obtained from another source, also including a synthetic source such as a Fischer-Tropsch process.

Usually the natural gas stream is comprised substantially of methane. Preferably the feed stream comprises at least 60 mol % methane, more preferably at least 80 mol % methane.

Depending on the source, the natural gas may contain varying amounts of hydrocarbons heavier than methane such as ethane, propane, butanes and pentanes as well as some aromatic hydrocarbons. The natural gas stream may also contain non-hydrocarbons such as $H_2O$, $N_2$, $CO_2$, $H_2S$ and other sulphur compounds.

If desired, the feed stream containing the natural gas may be pre-treated before use. This pre-treatment may comprise removal of undesired components such as $CO_2$ and $H_2S$ or other steps such as pre-cooling or pre-pressurizing. As these steps are well known to the person skilled in the art, they are not further discussed here.

The term "feed stream" as used herein relates to any hydrocarbon-containing composition usually containing a large amount of methane. In addition to methane, natural gas contains various amounts of ethane, propane and heavier hydrocarbons. The composition varies depending upon the type and location of the gas. Hydrocarbons heavier than methane generally need to be removed from natural gas for several reasons, such as having different freezing or liquefaction temperatures that may cause them to block parts of a methane liquefaction plant. $C_{2-4}$ hydrocarbons can be used as a source of Liquefied Petroleum Gas (LPG).

The term "feed stream" also includes a composition prior to any treatment, such treatment including cleaning, dehydration and/or scrubbing, as well as any composition having been partly, substantially or wholly treated for the reduction and/or removal of one or more compounds or substances, including but not limited to sulfur, sulfur compounds, carbon dioxide, water, and $C_2$+ hydrocarbons.

In a further aspect, the present invention provides apparatus for liquefying a hydrocarbon stream such as natural gas stream from a feed stream, the apparatus at least comprising:

a first cooling stage comprising two or more shell and tube heat exchangers having two or more tube circuits, each said shell and tube heat exchanger being provided with a first refrigerant comprising >90 mol % propane in a first cooling refrigerant circuit for removing heat from the feed stream to provide a cooled hydrocarbon stream, said first refrigerant circuit including one or more refrigerant compressors;

a second cooling stage comprising one or more heat exchangers arranged to receive the cooled hydrocarbon stream from the first cooling stage and to provide a liquefied hydrocarbon stream, the second cooling stage, preferably being a cryogenic cooling system, including at least a second refrigerant circuit using a second, preferably mixed, refrigerant to pass through and to be cooled by one or more of the shell and tube heat exchangers of the first cooling stage, said second refrigerant circuit including one or more refrigerant compressors; and a driver to commonly drive at least one refrigerant compressor of the first refrigerant circuit and at least one refrigerant compressor of the second refrigerant circuit.

Figure 2:
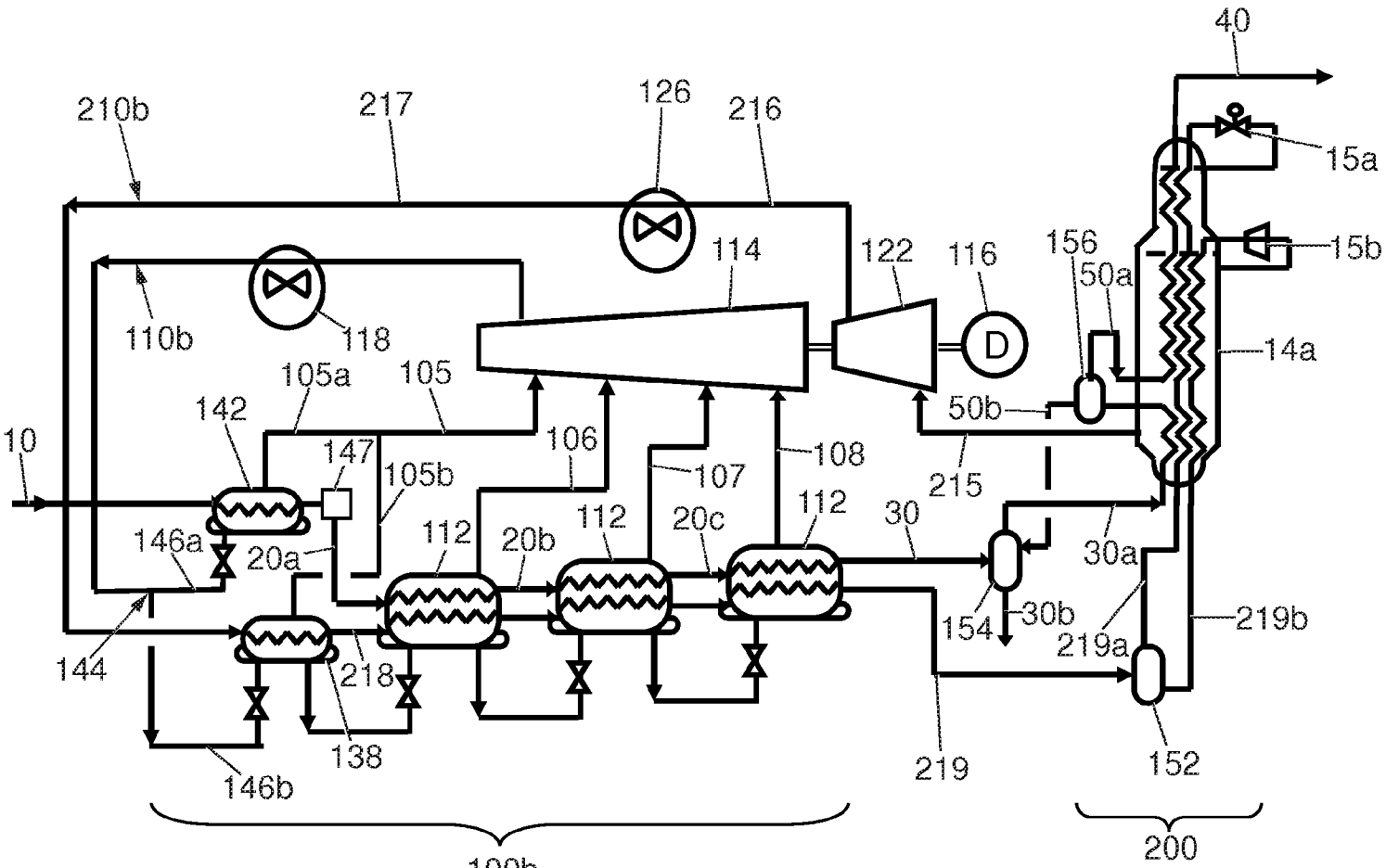
FIG. 2 is a second scheme for a liquefying process according to another embodiment of the present invention.

Embodiments of the present invention will now be described by way of example only, and with reference to the accompanying non-limiting drawings in which:

FIG. 1 is a scheme for a liquefying process according to one embodiment of the present invention; and FIG. 2 is a second scheme for a liquefying process according to another embodiment of the present invention.

For the purpose of this description, a single reference number will be assigned to a line as well as a stream carried in that line. Same reference numbers refer to similar components.

FIG. 1 shows a scheme for liquefying a hydrocarbon stream such as natural gas. It shows an initial feed stream containing natural gas 10, which feed stream may have been pre-treated to separate out at least some heavier hydrocarbons and impurities such as carbon dioxide, nitrogen, helium, water, sulfur and sulfur compounds, including but not limited to acid gases.

The feed stream 10 undergoes a first cooling in a first cooling stage 100*a* against a first refrigerant being cycled in a first refrigerant circuit 110*a*, thereby obtaining a cooled hydrocarbon stream 30.

The heat exchange for the first refrigerant circuit 110*a* may comprise at least two heat exchangers, e.g. two, three or four, through which the feed stream 10 passes, and each heat exchanger may also have a different pressure or pressure level. FIG. 1 shows a first cooling stage 100*a* having four heat exchangers 112. The heat exchangers 112 are part of the first refrigeration circuit 110*a* circulating a single component first.

The first single component refrigerant of the first refrigerant circuit 110*a* is preferably propane.

Optionally, the cooled stream 30 is then passed into a separation column (not shown), which column can separate the cooled stream 30 into a more liquid or heavier stream, generally being a heavier hydrocarbon rich stream, and a more gaseous or lighter stream, generally being a methane enriched stream for subsequent cooling and liquefaction. The heavier stream can be recycled or used for other product production.

Each heat exchanger 112 provides a cooler stream, 20*a*, 20*b*, 20*c*, to eventually provide a cooled hydrocarbon stream 30. Preferably, the first cooling cools down the feed stream 10 to approximately −20 to −70° C., such as about −25° C.

Using different pressure levels, such as, consecutively, high pressure, high pressure, medium pressure and low pressure, in each of the four heat exchangers 112 shown in FIG. 1, makes a more efficient arrangement where the refrigerant is propane. This is because the fraction of the refrigerant that is compressed over the full pressure ratio of the refrigerant compressor 114 is reduced. The use and arrangement of four different pressure levels in a refrigeration circuit is known in the art.

Generally, the vapour released from each heat exchanger 112 passes to and along a first compressor 114 in an arrangement known in the art, and the compressed refrigerant is then cooled by a cooler 118 before recirculation through the heat exchangers 112.

The heat exchangers 112 are shell and tube heat exchangers having two or more tube circuits. Preferably, the heat exchangers of the first cooling stage 110*a* are kettles having two or more tube circuits. The feed stream passes through one tube circuit in each heat exchanger and second refrigerant (discussed hereinafter) passes through another tube circuit in each heat exchanger. The first refrigerant then passes through the heat exchanger 112 around the feed stream 10 and second refrigerant.

The cooled hydrocarbon stream 30 can then pass through a second cooling stage 200 having at least one, preferably cryogenic, heat exchanger 14, to provide a liquefied hydrocarbon stream 40, such as liquefied natural gas. In the second cooling stage 200, there is a second refrigerant, preferably being a mixed refrigerant, being cycled in a second refrigerant circuit 210*a*.

In one embodiment of the present invention, the mixed refrigerant for the second refrigerant circuit 210*a* comprises:

>30 mol % of a compound selected from the group consisting of ethane and ethylene or a mixture thereof; and >30 mol % of a compound selected from the group consisting of propane and propylene or a mixture thereof. In general, the second refrigerant may be any suitable mixture of components including two or more of nitrogen, methane, ethane, ethylene, propane, propylene, butane, pentane, etc.

There can be various arrangements for the cooled hydrocarbon stream 30 and the second refrigerant stream in the second cooling stage 200. Such arrangements are known in the art. These can involve one or more heat exchangers 14, optionally at different pressure levels, and optionally within one vessel such as a cryogenic heat exchanger.

The second cooling stage 200 reduces the temperature of the cooled feed stream 30 to provide a liquefied hydrocarbon stream 40, which could be at a temperature of about or lower than −90° C., preferably lower than −120° C.

The second refrigerant of the second refrigerant circuit 210*a* passes through at least two heat exchangers 112 in the first cooling stage 100*a*. This arrangement simplifies the method of liquefying a hydrocarbon feed stream such as natural gas by combining a portion of the cooling duty of the first cooling of the feed stream with an equivalent portion of the cooling of the second refrigerant using the same equipment, rather than the second refrigeration circuit requiring its own separate or stand alone set of heat exchangers to sufficiently cool the second refrigerant for use in the second cooling stage 200. This therefore reduces the level of apparatus and equipment needed, and therefore reduces the capital and running costs for the process.

In the simplified form shown in FIG. 1, the second refrigerant circuit 210*a* includes a second compressor 122 and a water and/or air cooler 126. The second compressor 122 is mechanically interconnected by a drive shaft and so arranged to be driven by the driver 116 of the first compressor 114 of the first refrigeration circuit 110*a*. After the cooler 126, the second refrigerant stream 212 passes through the four heat exchangers 112 of the first cooling stage 100*a*. Thus, the second refrigerant is at least partly cooled by the first cooling stage 100*a*, to provide a cooled second refrigerant stream 214.

As well as simplifying the overall method of liquefying a hydrocarbon feed stream as mentioned above, this arrangement also reduces the space required for the scheme in FIG. 1, which can be advantageous where space is an issue. Moreover, using cooling from the first cooling stage to assist cooling of the second refrigerant can involve a simpler controlling system than that required for separate heat exchangers for each of the first and second refrigeration circuits 110*a*, 210*a*.

The liquefied stream 40 could then undergo a third cooling stage 300, such as sub-cooling, end flash, etc, or a combination of same. Sub-cooling can be carried out against a refrigerant being circulated in a third refrigerant circuit 310, thereby obtaining a further cooled liquefied stream 70. In simplified form, the third refrigerant circuit 310 involves a third compressor 132 driven by a driver 134, an air and/or water cooler 136. Additional cooling of the liquefied stream and/or the third refrigerant could be provided by one or more other refrigerants or refrigerant circuits, optionally being connected with another part of the method and/or apparatus for liquefying a hydrocarbon stream as described herein.

Further the person skilled in the art will readily understand that after liquefaction, the liquefied natural gas may be further processed, if desired. As an example, the obtained LNG may be depressurized by means of a Joule-Thomson valve or by means of a cryogenic turbo-expander.

FIG. 2 shows alternative embodiments in a scheme for liquefying hydrocarbon streams such as natural gas. As with FIG. 1, an initial feed stream 10 containing natural gas may be pre-treated to separate out at least some heavier hydrocarbons and impurities.

The feed stream 10 passes through a first cooling stage 100*b* having four heat exchangers 142, 112. As described in relation to FIG. 1, the heat exchangers 142, 112 are also part of the first refrigeration circuit 110*b* circulating a single component first refrigerant such as propane.

The feed stream 10 may be passed through a drying unit 147 as part of first cooling circuit 110*b*. In a further embodiment (not shown), heat exchanger 142 and/or drying unit 147 may be in a different physical location.

Each heat exchanger 142, 112 provides a cooler stream, 20*a*, 20*b*, 20*c* to eventually provide a cooled hydrocarbon stream 30 such as that described above. This cooled stream 30 can then pass through a second cooling stage 200 having at least one heat exchanger 14*a* to provide a liquefied hydrocarbon stream 40, (which liquefied stream 40 may optionally also undergo a third cooling as shown in FIG. 1).

The heat exchanger 14*a* in FIG. 2 is a spool-wound cryogenic heat exchanger, known in the art. It involves a number of lines passing up through the heat exchanger 14*a*, in particular a separated hydrocarbon stream 30*a* discussed hereinafter, and separated vapour and liquid second refrigerant streams 219*a* and 219*b* respectively, created by a gas/liquid separator 152 known in the art. The vapour and liquid second refrigerant streams 219*a* and 219*b* pass up through the heat exchanger 14*a*, are separately expanded outside the heat exchanger 14*a* by expanders 15*a*, 15*b* respectively, then passed back into the heat exchanger 14*a* to provide the cooling as is known in the art.

Compared with the scheme shown in FIG. 1, there are three alternative embodiments shown in the second refrigeration circuit 210*b* for the second cooling stage 200 in the scheme shown in FIG. 2.

Firstly, the second refrigerant circuit 210*b* still involves an exit refrigerant stream 215 from the heat exchanger 14*a* passing through a second compressor 122. In a similar manner to FIG. 1, FIG. 2 shows that second compressor 122 is mechanically interconnected by a drive shaft and so arranged to be driven by the driver 116 of the first compressor 114 of the first refrigeration circuit 110*b*. By using the power of one driver to drive two or more compressors, the capital cost of the overall liquefaction scheme is reduced, as each and every driver such as a gas turbine in a liquefaction plant is expensive, and contributes a considerable percentage to the overall capital and running costs of the plant. Moreover, the ratio of compressor power for the first and second refrigeration circuits 110*b*, 210*b* can be freely chosen to equal the optimum ratio, hence further reducing capital and running costs.

Where either the first refrigeration circuit 110*b* and/or second refrigeration circuit 210*b* of the first and second cooling stages 100*b*, 200 involves more than one refrigerant compressor, two or more of such compressors, either in the same circuit and/or from different circuits as shown in FIG. 2, may be mechanically interconnected and so be driven by the same driver in any combination that is suitable, provided that at least one refrigerant compressor of the first refrigerant circuit 110*b* and at least one refrigerant compressor of the second refrigerant circuit 210*b* are mechanically interconnected and are arranged to be driven by a common driver. Large industrial gas turbines are known which are able to provide required power for driving two or more compressors, and a changeable distribution of the power input allows for variation in loads of the compressors where non-steady state conditions are involved.

After passage through the second compressor 122, the refrigerant stream 216 passes through an air and/or water cooler 126 to provide a condensing refrigerant stream 217.

In the second alternative embodiment to FIG. 2, the natural gas stream 10 passes through a separate first heat exchanger 142 of the first refrigerant circuit 110*b*. This separate first heat exchanger 142 may be the same or different to the heat exchangers 138, 112 used in cooling of the condensing refrigerant stream 217. Preferably, the separate first heat exchanger 142 is the same or similar to at least the first heat exchanger 138 of the four heat exchangers 138, 112 used to cool the condensing refrigerant stream 217. Thus it is clear that in the process of the invention natural gas stream 10 need not pass through all of the heat exchangers of the first refrigerant circuit 110*b*.

Viewed in another way, the first part of the first cooling stage 110*b* uses two separate heat exchangers 138, 142 instead of the first common heat exchanger 112 shown in FIG. 1. The two separate heat exchangers 138, 142 may operate at the same or different pressure levels, preferably at a higher pressure level than the subsequent heat exchangers 112 of the first cooling stage 110*b*, and optionally at the same 'high high' pressure level of the common first heat exchanger described above in relation to FIG. 1.

In the arrangement shown in FIG. 2, the heat exchanger 138 is preferably a kettle heat exchanger, and is adapted to provide cooling only for the second refrigerant condensing stream 217, after which the refrigerant exit stream 218 is passed into the common second heat exchanger 112, similar to the line up in FIG. 1.

Thus, the separate first heat exchanger 142 only cools the feed stream 10 to provide a cooled hydrocarbon stream 20*a*, which is then passed into the common heat exchangers 112 in a similar manner to that in FIG. 1.

To provide cooling to the separate first heat exchanger 142 and first heat exchanger 138 used to cool condensing refrigerant stream 217, the first refrigerant in the first refrigerant circuit 110*b* can be divided by any suitable unit, device, for example a stream splitter 144, such that two part-first refrigerant streams 146*a*, 146*b* are created, the first part 146*a* of which can be used in the separate first heat exchanger 142, and the second part 146*b* of which can be used in the first heat exchanger 138 used to cool condensing refrigerant stream 217. The respective refrigerant vapour streams 105*a*, 105*b* from the separate first heat exchanger 142 and first heat exchanger 138 used to cool condensing refrigerant stream 217 can be combined to form a single stream 105 prior to their entry into the first compressor 114.

The second refrigerant stream 218 passes through the remaining second, third and fourth heat exchangers 112 as described above, to provide a cooled second refrigerant stream 219 ready for use in the heat exchanger 14*a* of the second cooling stage 200. The refrigerant vapour streams 106, 107 and 108 from the second, third and fourth heat exchangers 112 pass into the first compressor 114.

In the third alternative embodiment to FIG. 2, the cooled hydrocarbon stream 30 from the first cooling stage 100*b* passes through a separator 154, such as a separation column, which can separate the cooled hydrocarbon stream 30 into a more liquid or heavier stream 30*b*, generally being a heavier hydrocarbon-rich stream, including possible LPG products, and a more gaseous or lighter stream 30*a*, generally being a methane-enriched stream, for passage to the second cooling stage 200. The heavier stream 30*b* can be recycled or used for other product production. The lighter stream 30*a* enters the heat exchanger 14*a* of the second cooling stage 200.

In addition, FIG. 2 shows the possible division of the cooled second refrigerant stream 219 by a gas/liquid separator 152 into a vapour refrigerant stream 219*a* and a liquid refrigerant stream 219*b*. The separation can be carried out in a manner known in the art, and the resultant streams 219*a*, 219*b* can be used to provide the cooling in the heat exchanger 14*a* as hereinbefore described, and in a manner known in the art.

Further in addition in FIG. 2, the lighter hydrocarbon stream 30*a* after entering the heat exchanger 14*a*, can be removed therefrom and passed through another separator 156, so as to again provide a more gaseous or lighter stream 50*a*, (which can then be re-introduced into the heat exchanger 14*a* for further cooling, before emerging from the heat exchanger 14*a* as the liquefied hydrocarbon stream 40), and a more liquid or heavier stream 50*b*, generally being a heavier hydrocarbon-rich stream, which can be recycled into the separator 154 for the cooled hydrocarbon stream 30.

In a further alternative embodiment (not shown), the cooled hydrocarbon stream from the first cooling stage could be divided into any number of part-streams, based on any ratio of mass and/or volume and/or flow rate, such part-streams preferably being equal. The part-streams could then be separately liquefied by separate liquefaction systems, then optionally undergo either separate or combined third cooling. U.S. Pat. No. 6,389,844 B1 shows an example of a dual heat exchanger, dual refrigerant system, wherein a first cooling stage serves two main, preferably cryogenic, refrigeration systems.

Consequently, the depth to which the feed stream 10, which is preferably natural gas, is first-cooled may be reduced. Moreover, the conditions of the first cooling stage and for the liquefactions, for example the composition of the first refrigerant, can easily be adapted such that an efficient operation is achieved. Further, in case one of the main liquefying systems or one of its operations has to be reduced or taken out of operation, the conditions can be adapted to work efficiently with a single main liquefaction system. In this way, the liquefaction capacity can be increased without having to add a second first cooling stage, and this saves substantial costs.

In another further alternative embodiment (not shown), the first cooling stage comprises two or more parallel series of shell and tube heat exchangers such as kettles, through which the feed stream, first refrigerant and second refrigerant pass. Any arrangement of each of the streams through the different series of heat exchangers can be made to suit conditions and requirements of the first cooling stage. In one example, each of the three streams is divided equally into two or three-part streams, and each series of part streams are passed through separate series of parallel heat exchangers, optionally with combining of similar streams thereafter prior to the second cooling stage. Thus, the first cooling could be formed of two parallel series of three or four heat exchangers, each series accommodating half of the streams of feed, first refrigerant and second refrigerant, prior to the combination of the feed streams and second refrigerant streams back into single streams for the second and any third cooling stages.

Table I gives an overview of the temperatures, pressures, mass flow rates and phases of streams at various parts in the example process of FIG. 2.

TABLE I

| Line | Temperature (° C.) | Pressure (bar) | Mass flow (kg/s) | Phase |
|---|---|---|---|---|
| 10 | 46.3 | 68.4 | 146 | Mixed |
| 20a | 17.8 | 66.0 | 134 | Vapour |
| 30a | −23.4 | 65.3 | 142 | Vapour |
| 50a | −46.1 | 64.1 | 130 | Vapour |
| 40 | −152.4 | 60.4 | 131 | Liquid |
| 215 | −35.3 | 2.8 | 242 | Vapour |
| 216 | 82.3 | 51.8 | 242 | Vapour |
| 217 | 43.0 | 51.3 | 242 | Vapour |
| 219 | −33.0 | 49.9 | 242 | Mixed |
| 110b | 41.0 | 18.8 | 456 | Liquid |
| 105 | 14.7 | 7.2 | 183 | Vapour |
| 106 | −3.3 | 4.2 | 124 | Vapour |
| 107 | −21.0 | 2.4 | 92 | Vapour |
| 108 | −37.5 | 1.2 | 57 | Vapour |

The person skilled in the art will understand that the present invention can be carried out in many various ways without departing from the scope of the appended claims.

What is claimed is:

1. Method of liquefying a hydrocarbon stream from a feed stream, the method at least comprising the steps of:

(a) passing the feed stream through a first cooling stage having at least two heat exchangers comprising kettles having two or more tube circuits, and against a first single component refrigerant in a first refrigerant circuit, to provide a cooled hydrocarbon stream;

(b) passing the cooled hydrocarbon stream through a second cooling stage against a second refrigerant in a second refrigerant circuit, to provide a liquefied hydrocarbon stream; and (c) passing the second refrigerant through one or more of the heat exchangers of the first cooling stage;

wherein the heat exchangers of the first cooling stage are shell and tube heat exchangers having two or more tube circuits, the feed stream passing through one tube circuit in each shell and tube heat exchanger and the second refrigerant passing through another tube circuit in each shell and tube heat exchanger, and wherein the first refrigerant passes through the shell and tube heat exchangers around the feed stream and second refrigerant;

wherein the first refrigerant circuit includes one or more refrigerant compressors and the second refrigerant circuit includes one or more refrigerant compressors, and wherein at least one refrigerant compressor of the first refrigerant circuit and at least one refrigerant compressor of the second refrigerant circuit are mechanically interconnected and are arranged to be driven by a common driver; and wherein the first refrigerant comprises >90 mol % propane.

2. The method according to claim 1, wherein the first cooling stage comprises more than two heat exchangers.

3. The method according to claim 2 wherein each heat exchanger of the first cooling stage involves a different first refrigerant pressure.

4. The method according to claim 1 wherein the second refrigerant used in step (b) is a mixed refrigerant.

5. The method according to claim 1 wherein the liquefied hydrocarbon stream is further cooled.

6. The method according to claim 1 wherein a nominal capacity of the liquefied hydrocarbon stream is ≤3 MTPA.

7. Apparatus for liquefying a hydrocarbon stream from a feed stream, the apparatus at least comprising:

a first cooling stage comprising kettles having two or more tube circuits, each kettle being a part of shell and tube heat exchanger being provided with a first refrigerant comprising >90 mol % propane in a first refrigerant circuit for removing heat from the feed stream to provide a cooled hydrocarbon stream said first refrigerant circuit including one or more refrigerant compressors;

a second cooling stage comprising one or more heat exchangers arranged to receive the cooled hydrocarbon stream is from the first cooling stage and to provide a liquefied hydrocarbon stream, the second cooling stage including at least a second refrigerant circuit using a second refrigerant to pass through and to be cooled by one or more of the shell and tube heat exchangers of the first cooling stage, said second refrigerant circuit including one or more refrigerant compressors; and a driver to commonly drive at least one refrigerant compressor of the first refrigerant circuit and at least one refrigerant compressor of the second refrigerant circuit.

8. The apparatus as claimed in claim 7 wherein the first cooling stage comprises four or five heat exchangers.

9. The apparatus as claimed in claim 7 further comprising a sub-cooling stage comprising one or more sub-cooling heat exchangers arranged to receive the liquefied hydrocarbon stream liquefied in the second cooling stage and to provide a sub-cooled liquefied hydrocarbon stream, the sub-cooling stage including a sub-cooling refrigerant circuit using a mixed refrigerant for removing heat from the liquefied hydrocarbon stream flowing through the sub-cooling heat exchangers.

10. The apparatus as claimed in claim 7 wherein a nominal capacity of the apparatus is ≤3 MTPA.

11. The method according to claim 1 wherein the first cooling stage comprises four or five heat exchangers.

12. The method according to claim 11 wherein each heat exchanger of the first cooling stage involves a different first refrigerant pressure.

13. The method according to claim 1 wherein the second refrigerant used in step (b) is a mixed refrigerant, and comprises:

>30 mol % of a compound selected from the group consisting of ethane and ethylene or a mixture thereof; and >30 mol % of a compound selected from the group consisting of propane and propylene or a mixture thereof.

* * * * *